US011148690B2

(12) United States Patent
Fries et al.

(10) Patent No.: US 11,148,690 B2
(45) Date of Patent: Oct. 19, 2021

(54) METHOD, SYSTEM, AND SOFTWARE CODE FOR CALIBRATION OF RAIL TRACK CIRCUITS, AND RELATED RAIL TRACK CIRCUIT

(71) Applicant: ALSTOM Transport Technologies, Saint-Ouen (FR)

(72) Inventors: Jeffrey Fries, Grain Valley, MO (US); Nenad Mijatovic, Melbourne, FL (US)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 333 days.

(21) Appl. No.: 16/367,936

(22) Filed: Mar. 28, 2019

(65) Prior Publication Data

US 2020/0307660 A1 Oct. 1, 2020

(51) Int. Cl.

| | |
|---|---|
| ***B61L 1/18*** | (2006.01) |
| ***B61L 25/02*** | (2006.01) |
| ***B61L 23/04*** | (2006.01) |

(52) U.S. Cl.

CPC ..... *B61L 1/188* (2013.01); *B61L 23/044* (2013.01); *B61L 25/025* (2013.01)

(58) Field of Classification Search

CPC ..... B61L 1/188; B61L 23/044; B61L 25/025
See application file for complete search history.

(56) References Cited

U.S. PATENT DOCUMENTS

| | | | | |
|---|---|---|---|---|
| 9,254,852 | B2 * | 2/2016 | Lawson | B61L 1/181 |
| 2009/0173842 | A1 * | 7/2009 | Lawson | B61L 1/20 246/34 R |
| 2012/0232813 | A1 * | 9/2012 | Lawson | B61L 1/181 702/58 |
| 2015/0192636 | A1 * | 7/2015 | Fries | B61L 29/30 324/511 |
| 2015/0210304 | A1 * | 7/2015 | Noffsinger | B61L 23/044 246/121 |
| 2015/0367872 | A1 * | 12/2015 | Plotnikov | B61L 3/18 246/121 |
| 2016/0090113 | A1 * | 3/2016 | Nagrodsky | B61L 1/18 246/34 R |
| 2016/0194012 | A1 * | 7/2016 | Matthews | B61L 3/10 246/121 |
| 2016/0244078 | A1 * | 8/2016 | Noffsinger | B61L 3/10 |
| 2018/0065650 | A1 * | 3/2018 | Plotnikov | B61L 3/10 |
| 2020/0307660 | A1 * | 10/2020 | Fries | B61L 1/188 |

* cited by examiner

*Primary Examiner* — Jason C Smith
(74) *Attorney, Agent, or Firm* — B. Aaron Schulman, Esq.; Stites & Harbison, PLLC

(57) ABSTRACT

Method, system and software code for calibrating a rail track circuit comprising a plurality of rails coupled to form a track section having a predefined length, a transmit processing unit coupled to the track section at a first end of the track section, and a receive processing unit coupled at the second end of the track section. A transfer function between a transmit voltage applied by the transmit processing unit at the track section and a resulting receive current detected at the receive processing unit is first determined and then applied to the rail track circuit for automatic initial calibration or recalibration.

13 Claims, 3 Drawing Sheets

METHOD, SYSTEM, AND SOFTWARE CODE FOR CALIBRATION OF RAIL TRACK CIRCUITS, AND RELATED RAIL TRACK CIRCUIT

BACKGROUND OF THE DISCLOSURE

The present disclosure relates in general to the field or railway systems, and more specifically to a method, system and software code for calibration of rail track circuits, and to a related rail track circuit of a railway or railroad line.

As known, track circuits are systems performing critical safety functions in the monitoring and management of traffic over a railway network and therefore they require a very precise configuration, either when they are calibrated at the time of first installation and thereafter during their lifetime service.

In particular, rail track circuits are primarily used to detect whether a train is present on a track section; they can be also used to detect broken rails within the track section, and/or to transmit signal aspect information through the rails, for example to communicate movement authorities of transiting trains.

To this end, track circuits use electrical signals applied to the rails and a typical track circuit includes a certain number of rails, forming a given rail section, which are in electrical series with a signal transmitter and a signal receiver, usually positioned at respective ends of the given rail section. The signal transmitter applies a voltage, sometimes referred to as a transmit voltage, to the rails; as a result, a current signal, sometimes referred to as a transmit current, is transmitted through the rails. A portion of the transmit current, sometimes referred to as a receive current is detected by the receiver.

When a train composed of one or multiple vehicles or railcars is located on the track section of the relevant track circuit, the wheels of the railcars act as a shunt between the rails and form a shunt path. The shunt path creates an electrical short between the rails at the location of the train, and such short path effectively prevents the receive current from being received/detected by the signal receiver.

A main issue related to track circuits resides in the fact that they are sensitive to operational and environmental conditions that impact the initial electrical characteristics of the relevant track section. In particular, over time, environmental conditions and rail conditions can change and, for example, these changing conditions impact the ballast electrical resistance between the rails of the track circuit. As a consequence, leakage paths occur through the ballast, and even the leakage resistance of such leakage paths varies due to the changing conditions, thus impacting on the values of the receive current.

As a matter of fact, a track circuit may not be configured optimally for the actual conditions of the relevant track section and of any component of the track circuit itself, and in such circumstances it may falsely detect a train or, even worse, it may fail to detect a train.

In order to mitigate such issues, track circuits are subject to maintenance interventions where they are re-calibrated.

For this purpose, known and very common solutions foresee the intervention of specialized technicians on the field. For example, a calibration technique requires positioning "maintainers" with two-way radios at the transmitter and receiver sites, respectively, which are usually spaced apart from each other by some kilometers. The maintainer at the transmitter side communicates data related to the applied voltage to the maintainer at the receiver side. The receiver maintainer then informs the transmitter maintainer of the current signal received. Such data are exchanged in coordination with a central office to validate the track circuit setup by simulating a train at the tracks with a shunting device. In this way adjustments are finally made to both the transmitter and receiver so that the track circuit operates as desired over the actual conditions of the track section.

Clearly, such process of manually calibrating the track circuit settings is costly, inefficient and/or time-consuming. Indeed, track circuit configuration and adjustments require lots of time from maintenance forces and temporarily halt the movement of trains, thus resulting in perturbation of the traffic and in substantial financial losses.

BRIEF DESCRIPTION OF THE INVENTION

Hence, it is evident that there is room and desire for improvements in the way track circuits are initially calibrated and then maintained and recalibrated once in service.

The present disclosure is aimed at providing a solution to this end and, in one aspect, it provides a method for calibrating a rail track circuit comprising a plurality of rails coupled to form a track section having a predefined length, a transmit processing unit coupled to the track section at a first end of the track section, and a receive processing unit coupled at a second end of the track section, the method comprising at least the following steps:

- determining a transfer function between a transmit voltage applied by the transmit processing unit at the track section and a resulting receive current detected at the receive processing unit;
- calibrating the rail track circuit applying the determined transfer function to the rail track circuit.

In another aspect, the present disclosure provides a track circuit comprising:

- a plurality of rails coupled to form a track section having a predefined length;
- a transmit processing unit coupled to the track section at a first end of the track section, the transmit unit being configured to apply one or more predefined transmit voltages to said track section;
- a receive processing unit coupled at a second end of the track section, the receive processing unit being configured to detect a receive current and to be calibrated based on a determined transfer function between a predetermined transmit voltage applied by the transmit processing unit and a resulting receive current to be detected at the receive processing unit.

In another aspect, the present disclosure provides a control system for a railway line comprising:

- at least one track circuit comprising a plurality of rails coupled to form a track section having a predefined length, a transmit processing unit coupled to the track section at a first end of the track section, the transmit unit being configured to apply one or more predefined transmit voltages to said track section, and a receive processing unit coupled at a second end of the track section, said receive processing unit being configured to detect a receive current;
- a controller in communication with the at least one track circuit, the controller being configured for remotely causing calibration of the at least one track circuit based on a determined transfer function between a predetermined transmit voltage applied by the transmit processing unit and a resulting receive current to be detected at the receive processing unit.

In a further aspect, the present disclosure provides a computer-readable medium comprising software code stored therein for calibrating a track circuit comprising a plurality of rails coupled to form a track section having a predefined length, a transmit processing unit coupled to the track section at a first end of the track section, the transmit unit being configured to apply one or more predefined transmit voltages to the track section, and a receive processing unit coupled at a second end of the track section, said receive processing unit being configured to detect a receive current based on a determined transfer function between a predetermined transmit voltage applied by the transmit processing unit and a resulting receive current to be detected at the receive processing unit, the stored software code, when executed by a processor, executing or causing execute at least the following instructions:

determining a transfer function between a transmit voltage applied by the transmit processing unit at the track section and a resulting receive current detected at the receive processing unit;

calibrating the rail track circuit applying the determined transfer function to the rail track circuit.

BRIEF DESCRIPTION OF THE DRAWINGS

Detailed characteristics and advantages will become apparent from the description of some preferred but not exclusive exemplary embodiments of a method of calibration of a rail track circuit and related rail track circuit, according to the present disclosure, illustrated only by way of non-limitative examples with the accompanying drawings, wherein.

DETAILED DESCRIPTION OF THE DISCLOSURE

Figure 1:
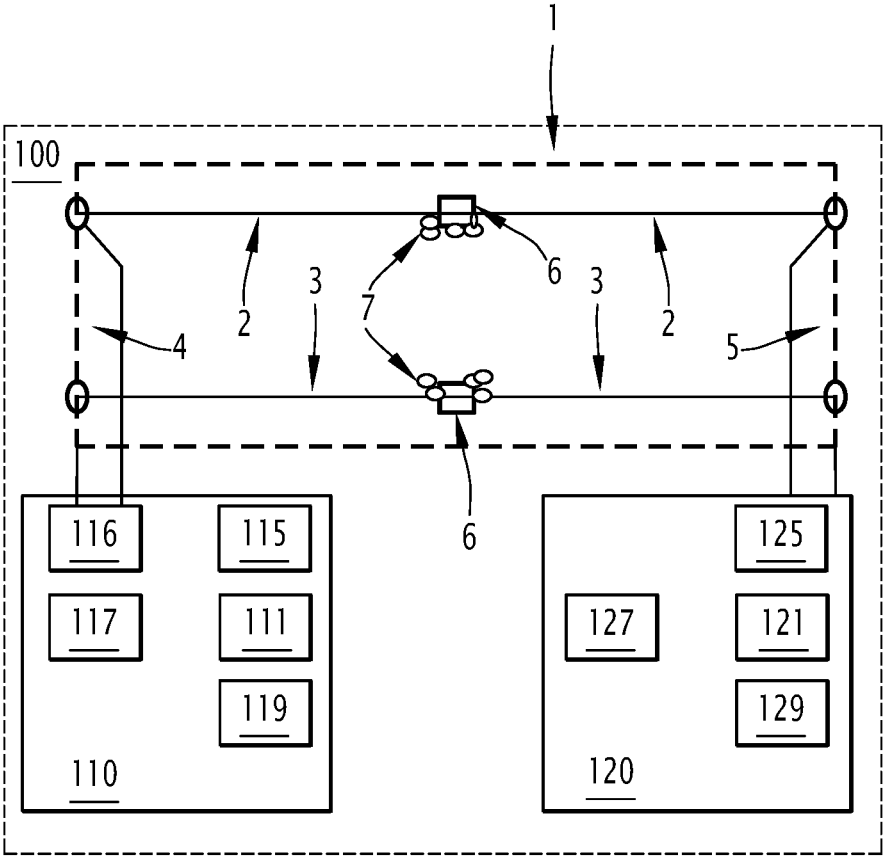
FIG. 1 is a schematic illustration of a track circuit of a railway line calibrated using a method according to an embodiment of the present disclosure.

It should be noted that in the detailed description that follows, identical or similar components, either from a structural and/or functional point of view, may have the same reference numerals, regardless of whether they are shown in different embodiments of the present disclosure. It should be also noted that in order to clearly and concisely describe the present disclosure, the drawings may not necessarily be to scale and certain features of the disclosure may be shown in somewhat schematic form.

Further, when the term "adapted" or "arranged" or "configured" or "shaped", is used herein while referring to any component as a whole, or to any part of a component, or to a combination of components, it has to be understood that it means and encompasses correspondingly either the structure, and/or configuration and/or form and/or positioning. In particular, for electronic and/or software means, each of the above listed terms means and encompasses electronic circuits or parts thereof, as well as stored, embedded or running software codes and/or routines, algorithms, or complete programs, suitably designed for achieving the technical result and/or the functional performances for which such means are devised.

Figure 2:
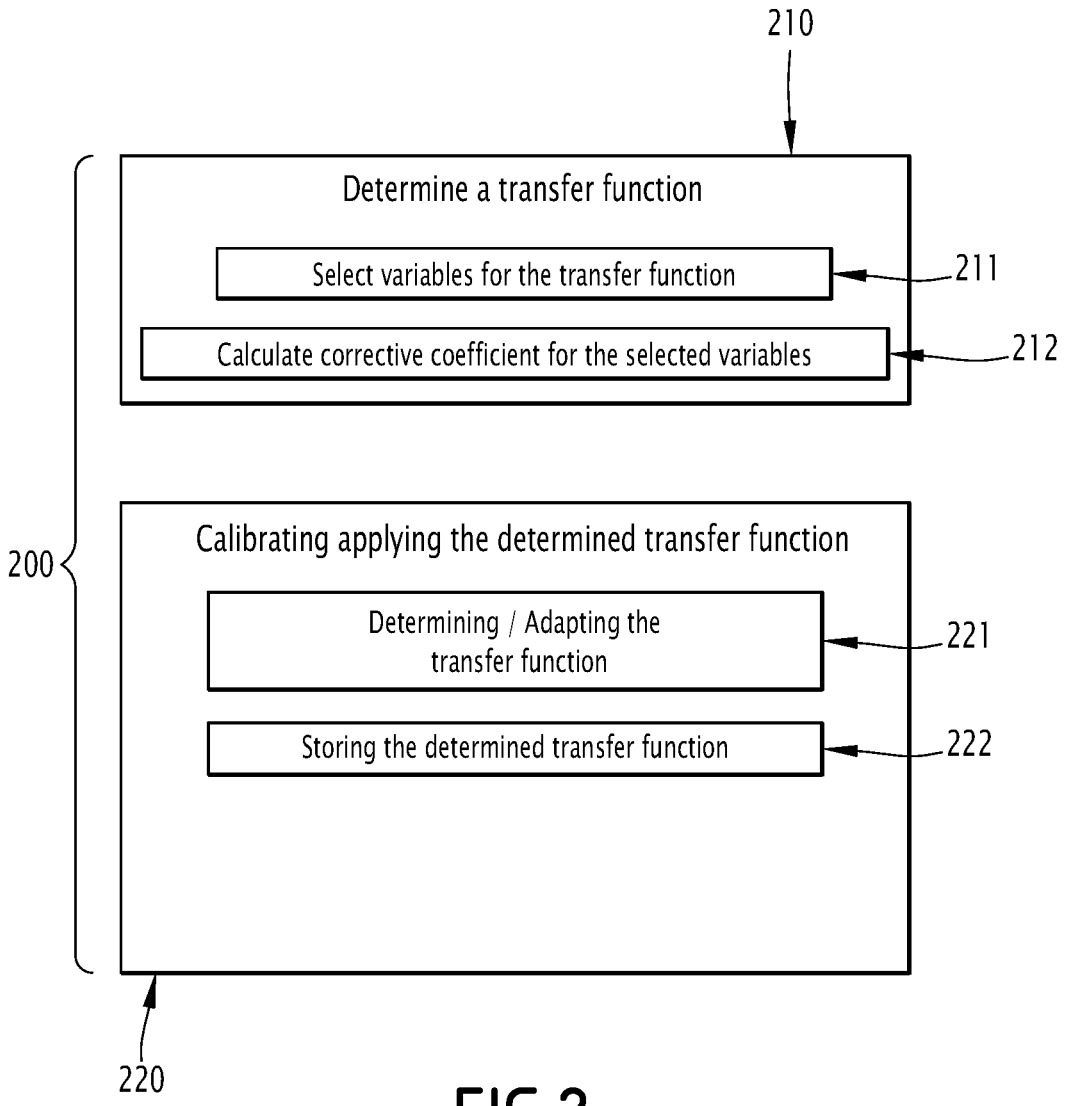
FIG. 2 is a flowchart depicting a method for calibrating a track circuit of a railway line according to the present disclosure.

FIGS. 1 and 2 illustrate a track circuit 100 and a method 200 for calibrating such a track circuit 100, respectively, according to possible exemplary embodiments of the present disclosure.

In particular, as schematically illustrated in FIG. 1, the represented track circuit 100 comprises a track section 1 having a predetermined overall length (L). The track section 1 comprises a plurality of rails 2 and 3, the rails 2 and the rails 3 being arranged in parallel to form the track section on which a railway vehicle can run and the rails 2 and the rails 3 being respectively coupled in series. The rails 2 and the rails 3 form the track section 1, and have a first end 4 and a second opposite end 5. For ease of illustration, in FIG. 1 there are illustrated only two rails 2 and two corresponding rails 3.

According to solutions well known in the art and therefore not described herein in details, the rails 2 and the rails 3 are respectively coupled to each other in sequence, for example by means of fishplates, schematically represented in FIG. 1 by the reference number 6. Advantageously, the rails 2 are attached to the rails 3 through ties, which are laid in the ground and substantially covered with ballast, i.e. small stones, to hold the ties in place. In FIG. 1, the ballast has been represented in FIG. 1 by the reference number 7 only at a small area just for ease of illustration. The ties extend perpendicularly to the rails 2 and 3.

In one embodiment, the track circuit 100 comprises a transmit processing unit 110 which is coupled to the track section 1, for example at or adjacent to the first end 4, and a receive processing unit 120 which is coupled to the track section 1, for example at or adjacent to the second end 5. The transmit processing unit 110 comprises an energy source 115 and is configured to apply a predefined transmit voltage $V_{tx}$ to the track section 1 during operations. For example, the transmit processing unit 110 may be configured to apply a voltage across the track section 1 at the end 4, thereby generating a transmit current. The transmit processing unit 110 can be provided for example by suitable circuitry 116, adapted to generate different levels of coded voltages, e.g. DC voltages.

In turn, the receive processing unit 120 comprises an energy source 125 and is configured to detect a receive current $I_{rx}$ during operations based on the applied transmit voltage. In particular, and as it will be described in more details hereinafter, the receive processing unit 120 is configured to detect the receive current $I_{rx}$ based on a determined transfer function between the predetermined transmit voltage applied by the transmit processing unit 110 and the resulting receive current to be detected by the receive processing unit 120 itself.

The transfer function is related to parameters of the track section and its environment.

As illustrated in FIG. 2, the method 200 for calibrating a rail track circuit, e.g. the illustrated track circuit 100 of FIG. 1, comprises at least the following steps:

210: determining a transfer function between a transmit voltage $V_{tx}$ applied by the transmit processing unit 110 at the track section 1 and a resulting receive current $I_{rx}$ detected at the receive processing unit 120;

220: calibrating the rail track circuit applying the determined transfer function to the rail track circuit 100.

In the method 200 according to the present disclosure, the step 210 of determining a transfer function comprises a sub-step 211 of selecting or calculating one or more variables, in particular a plurality of variables, suitable to influence the values of the resulting receive current $I_{rx}$ detected at the receive processing unit 120. In particular, according to a possible embodiment, the sub-step 211 comprises selecting or calculating one or more variables including the rail electrical resistance $R_r$ of the track section 1, the ballast electrical resistance $R_b$ of the track section 1, the electrical resistance $R_{stx}$ of the energy source 115 of the transmitter processing unit 110, and the electrical resistance $R_{srx}$ of the energy source 125 of the receiver processing unit 120.

According to one possible embodiment of the method 200, the step 210 of determining a transfer function comprises another sub-step 212 wherein, for each of the variables selected or calculated, there is determined one or more coefficients related to and applicable to values of corresponding selected variables. In particular, according to an exemplary embodiment, at sub-step 212 there are calculated one or more corrective coefficients, for instance two different coefficients $parR_{b1}$ and $parR_{b2}$ suitable to be applied to given values of the ballast electrical resistance ($R_b$) of the track section 1, and/or at least one corrective coefficient $parR_r$ suitable to be applied to given values of the rail electrical resistance $R_r$ of the track section 1, and/or at least one corrective coefficient $parR_{stx}$ suitable to be applied to given values of the electrical resistance $R_{stx}$, of the energy source 115 of the transmit processing unit 110, at least one corrective coefficient $parR_{srx}$ suitable to be applied to given values of the electrical resistance $R_{srx}$, of the energy source 125 of the receive processing unit 120. Advantageously the corrective coefficients are function of the track section length.

According to possible embodiments and depending on applications, during the step 210 only the second step 212 can be carried out if desired and/or applicable.

According to a possible embodiment, the transfer function is determined by the following equation (F):

$$I_{rx} = \text{constant} + \frac{parRb1 \cdot R_b}{parRb2 + R_b} + parRr \cdot R_r + \frac{parRs_{tx}}{Rs_{tx}} \frac{parRs_{rx}}{Rs_{rx}}$$

wherein: $I_{rx}$ is the receive current detected by the receive processing unit 120 resulting from a predefined value of voltage $V_{tx}$ applied by the transmit processing unit 110; $R_b$ is the ballast electrical resistance, measured for example in Ohms per 1,000 ft, of the track section 1 of a track circuit 100 to be calibrated, and $parR_{b1}$, and $parR_{b2}$ are a first coefficient and a second coefficient, respectively, suitable to be applied to given values of the ballast electrical resistance $R_b$; $R_r$ is a rail electrical resistance, measured for example in Ohms per feet, of the track section 1 and $parR_r$ is the corrective coefficient suitable to be applied to given values of the rail electrical resistance $R_r$; $R_{stx}$ is the electrical resistance, measured in Ohms, of the energy source 115 of the transmit processing unit 110 and $parR_{stx}$ is a corrective coefficient suitable to be applied to given values of the electrical resistance $R_{stx}$ of the energy source 115 of the transmit processing unit 110; $R_{srx}$ is the electrical resistance, measured in Ohms, of the energy source 125 of the receive processing unit 120, and $parR_{srx}$ is the corrective coefficient suitable to be applied to given values of the electrical resistance $R_{srx}$ of the energy source 125 of the receive processing unit 120.

For example, some practical values for these parameters are $V_{tx}$=2.5 V, $R_r$=10 Ohms per 1,000 ft, $parR_{b1}$=1.23, $parR_{b2}$=1.99, $R_r$=10 microOhms per feet, $parR_r$=−0.14, $R_{stx}$=0.4 Ohms, $parR_{stx}$=0.16, $R_{srx}$=0.4 Ohms, $parR_{srx}$=0.16 and constant=−0.78.

The determined transfer function can be applied when a track circuit 100 is going to be put in service, i.e. for an initial calibration/configuration, and/or it can be used for later calibrations at any time desired, scheduled or required during lifetime service operations. Accordingly, the step 220 of calibrating the rail track circuit applying the determined transfer function to the rail track circuit comprises a first sub sub-step 221 of determining/adapting the transfer function of the track circuit and applying the determined transfer function to the rail track circuit 100. In particular the rail track circuit 100 is initially calibrated via the determined transfer function in step 210 based on a coded value for the applied transmit voltage $V_{tx}$, for example a coded DC voltage of 2.5 Volts, and on measured values for the ballast electrical resistance $R_b$, for the rail electrical resistance $R_r$ of the track section 1, for the electrical resistances $R_{stx}$, $R_{srx}$ of the energy sources 115 and 125 of the transmit processing unit 110 and of the receive processing unit 120, respectively. The measured values are obtained through exchange of transmit voltage, transmit current and receive current through the rails between the transmit processing unit and receive processing unit.

Likewise, when the track circuit 100 is in operations or during its initialization after its installation on the track, the sub-step 220 of calibrating the track circuit comprises:

determining/adapting the transfer function of the track circuit by calculating actual values for one or more of the electrical resistance $R_b$ of the ballast, the rail electrical resistance of the track section $R_r$, the electrical resistances $R_{stx}$, $R_{srx}$ of the energy sources 115, 125 of the transmit processing unit 110 and of the receive processing unit 120, and applying the determined transfer function to the track circuit 100 to calibrate it based on the actual values calculated for the one or more of the electrical resistance $R_b$ of the ballast, the rail electrical resistance of the track section $R_r$, the electrical resistances $R_{stx}$, $R_{srx}$ of the energy source of the transmit processing unit of the receive processing unit and advantageously the corrective coefficients determined in step 212.

Advantageously, when the determined transfer function is applied, a first threshold of the track circuit 1 for detecting the presence or absence of a railway vehicle, e.g. a train, on the track section 1, is for example adjusted in function of the value of the receive current $I_{rx}$ determined via the transfer function.

Alternatively, or at the same time, the gain of the transmit processing unit 110 is adjusted in function of the value of the receive current $I_{rx}$ determined via the transfer function.

In particular, according to an advantageous embodiment, the value of the receive current $I_{rx}$ determined via the transfer function is compared with a value of the receive current $I_{rx}$ measured at the receive processing unit 120 and if the gap between the determined value and the measured value of the receive current $I_{rx}$ is above a second threshold, an alarm is raised, otherwise the value of the first threshold and/or of the gain of the transmit processing unit 110 is adjusted in function of the value of the actual gap.

The ratio between the measured value of the receive current $I_{rx}$ and that determined, namely calculated, via the transfer function, is for instance equal to +/−20%.

Advantageously, after applying the determined transfer function, the method comprises simulating the presence of a train by shunting the track circuit 1 and checking the good detection at the receiver processing unit 120 of a corresponding signal indicative of the simulated presence of a train.

For example, such simulation can be performed using a relay device (not illustrated in figures) linking the rails 2 and the rails 3 which relay device is actuated to simulate the presence of a train by closing a contact that shunts the track circuit 1.

Figure 3:
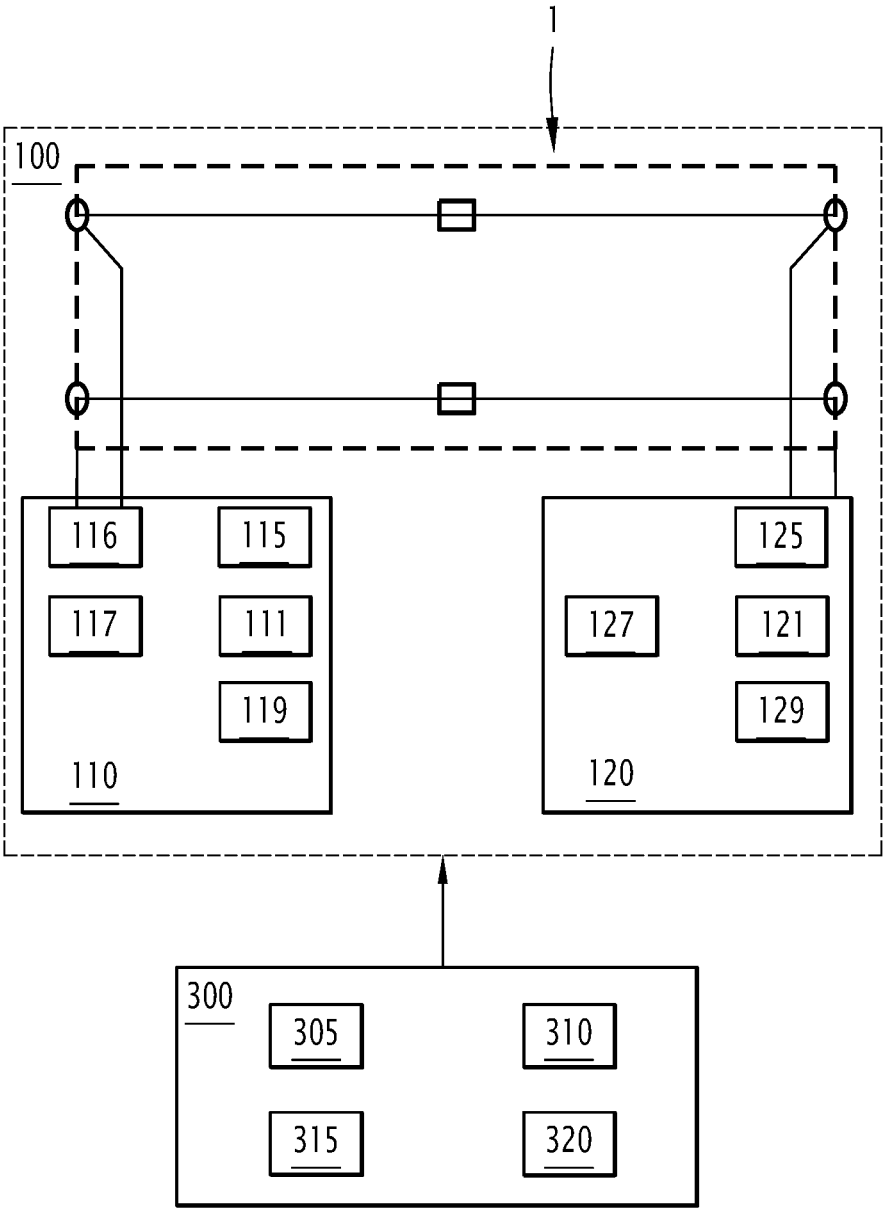
FIG. 3 is a block diagram schematically illustrating a control system of a railway line usable in connection with and for the calibration of the track circuit of FIG. 1, according to an embodiment of the present disclosure.

A track circuit 100 according to the present disclosure can be suitably configured in order to perform autonomous and substantially automatic self-calibrations, or it may be automatically calibrated, operated, and monitored from a remote location, for example by a logic controller of a railway control system, indicated schematically in FIG. 3 by the reference numbers 310 and 300, respectively.

Accordingly, at least one of the transmit or receive processing units 110, 120 comprises a communication module in data communication with a communication module 305, e.g. a transceiver of the control system 300.

In the exemplary embodiment illustrated in FIGS. 1 and 3, both the transmit and receive processing units 110, 120 comprise a corresponding communication module, e.g. a respective transceiver 111 and 121, respectively, in data communication with the transceiver 305 and with each other.

According to possible embodiments of the present disclosure, there is provided at least one logic controller or module having or being connected to a storing unit e.g. a memory, for storing the determined transfer function and/or various specific equations/models obtained by entering into the transfer function (F) specific given or actually measured values for the selected variables, and/or values of one or more of the related corrective coefficients above indicated.

According to a possible embodiment, at least the receive processing unit 120 comprises a local logic controller or module 127 and a storage unit 129 for storing the determined transfer function and/or various specific equations/models obtained by entering into the transfer function (F) specific given or actually measured values for the selected variables, and/or values of one or more of the related corrective coefficients above indicated.

According to another possible embodiment, and as illustrated in FIGS. 1 and 3, also the transmit processing unit 110 comprises a logic controller or module 117 and a storage unit 119. Hence, it is possible to have only one unit or both units 110 and 120 comprising a corresponding logic controller and storage unit. Each of the logic controllers 117, 127, 310 can include any processor-based device, e.g. a microprocessor, microcontroller, a microcomputer, a programmable logic controller, an application specific integrated circuit, or any other programmable circuit. Therefore, the term processor, as used herein, is not limited to just those integrated circuits referred to in the art as computers, but broadly refers to microprocessors, microcontrollers, microcomputers, programmable logic controllers, application specific integrated circuits, and other programmable circuits, and these terms are used interchangeably herein.

According to a possible embodiment, and as illustrated in FIG. 3, also the railway control system 300 comprises a storage unit 315, e. g. a memory, for storing the determined transfer function and/or various specific equations/models obtained by entering into the transfer function (F) specific given or actually measured values for the selected variables, and/or values of one or more of the related corrective coefficients above indicated. Such storage unit 315 can be used in addition or in alternative to the local storage unit 129 and/or 119.

Accordingly, the step 220, comprises a sub-step 222 of storing at least the determined transfer function in one or more of the provided storage units 117, 127, 320. As those skilled in the art can appreciate, the sub-step 222 of storing can be performed before or after having performed a calibration of the relevant track circuit.

Further, as those skilled in the art would appreciate and based on the foregoing description, the above-described embodiments of the disclosure may be implemented using computer programming including computer software, firmware, hardware or any combination or subset thereof, wherein the technical effect is to calibrate a track circuit. Any such resulting program, having computer-readable code means, may be embodied or provided within one or more computer-readable media, thereby making a computer program product, i.e., an article of manufacture, according to the discussed embodiments of the disclosure. The computer readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network. In practice the devised code includes software instructions which, once executed by a processor, carry out and/or cause suitable machinery and/or equipment, to carry out the various steps of a method 200 as described in the foregoing description, and in particular as defined in the appended relevant claims.

Hence, it is evident that the rail track circuit 100, the method 200 and control system 300 according to the present disclosure, enable automatic evaluation and calibration of a section of a railroad track. Accordingly, the need for manual setup and calibration is eliminated, thereby facilitating a reduction in the chance for error, in costs and/or time associated with maintenance of the railroad. In practice, the determined transfer function (F) allows to accurately predict the track circuit receiver currents once there are given known or measured inputs for the variables selected, such as the ballast electrical resistance, the rail electrical resistance, and the electrical resistances of the energy sources associated to calculated values of the above mentioned one or more corrective coefficients. In particular, starting from the established transfer function, it is possible to build a database of specific models by applying different input values of the variables depending on the selected length L of the track section of a track circuit and on the level of transmit voltage applied by the transmit processing unit 110. For instance, once a transmit voltage is selected, the above indicated corrective coefficients can be calculated directly for each desired length L of a track section 1, or they can be determined for two specific track lengths, for example for a length of 4 km and for a length of 5 km; then, for any track length in between, the respective coefficients can be determined by means of interpolation between the two models calculated for the lengths of 4 km and 5 km. Further, while each model can be generated for a predefined transmit voltage, e.g. of 1.0V, the output of each model can be scaled when changing the actual transmit voltage, e.g. passing to 2.4V.

In addition, these models allow track circuits monitoring their environment, and validating the changes in receiver current against changes in the relevant and surrounding environment. Indeed, while the track length is fixed and known at the time of installation, and the transmit voltage is fixed and set at the time of initial configuration, the ballast and rail electrical resistances are variable over time, but they can be calculated dynamically from the track circuit data using known formulas.

One example of a known formula comes from AREMA manuals:

Rrail=2*(Vtx−Vrx)/(Track length)*(Itx+Irx); Ohms/ft

Rballast=(Track length)*(Vtx+Vrx)/2*1000*(Itx−Irx); Ohms*1000 ft where $V_{tx}$ and $V_{rx}$ are the voltage at the rails of the transmit end or receive end respectively, $I_{rx}$ is the transmit current and $I_{rx}$ is the receive current. Some of such data come from the transmit end of the circuit and some from the receive end. All of the data must be known to perform the calculation, so such data must be collected in a single location, for example, shared between the transmit and receive ends through communications.

Likewise, the electrical resistance of the energy sources 115, 125 of the transmitter and receiver processing units 110, 120 are fixed at the time of installation, but they can vary for some reasons over time, e.g. if the connections degrade. The actual values can be validated with each passing train doing simple Ohm's law calculations knowing the applied transmit voltage and current.

As an example, if it is known that the transmit voltage is 2.5V, and a train is known to be passing over the transmit connections to the track, if the transmit current is 2.5A, then the connection resistance can be calculated as 2.5V/2.5A=1 Ohm. Any of the actual values for the variables selected, if changed, can be applied to the relevant model and thus the equipment can safely automate the adjustment of a track circuit when necessary, without the need for maintenance personnel at the relevant site.

The method 200, system 300 and rail track circuit 100 thus conceived are susceptible of modifications and variations, all of which are within the scope of the inventive concept as defined in particular by the appended claims; for example, some parts of the control system 300 may reside on the same electronic unit, or they can even be realized as subparts of a same component or circuit of an electronic unit, or they can be placed remotely from each other and in operative communication there between. All the details may furthermore be replaced with technically equivalent elements.

What is claimed is:

1. A method for calibrating a rail track circuit, said rail track circuit comprising:

a plurality of rails coupled to form a track section having a predefined length, a transmit processing unit coupled to the track section at a first end of the track section, and a receive processing unit coupled to the track section at a second end of the track section, wherein the method comprises:

determining a transfer function between a transmit voltage applied by the transmit processing unit at said first end of the track section and a resulting receive current detected at said second end by the receive processing unit; and calibrating the rail track circuit by applying the determined transfer function to the rail track circuit, and wherein the determining of the transfer function further comprises selecting or calculating one or more variables suitable to influence the values of the resulting receive current detected by the receive processing unit, the selected or calculated variables including one or more of a resistance selected from the group consisting of a rail electrical resistance ($R_r$) of the track section, a ballast electrical resistance ($R_r$) of the track section, an electrical resistance ($R_{stx}$) of an energy source of the transmit processing unit, and an electrical resistance ($R_{srx}$) of an energy source of the receive processing unit.

2. The method for according to claim 1, wherein the determining of the transfer function further comprises determining one or more coefficients applicable to values of the corresponding selected or calculated variables.

3. The method according to claim 2, wherein the determining of one or more coefficients comprises:

calculating at least one corrective coefficient ($parR_r$) suitable to be applied to values of the rail electrical resistance ($R_r$) of the track section; and/or calculating at least one corrective coefficient ($parR_b$) suitable to be applied to values of the ballast electrical resistance ($R_b$) of the track section; and/or calculating at least one corrective coefficient ($parR_{stx}$) suitable to be applied to values of the electrical resistance ($R_{stx}$) of the energy source of the transmit processing unit; and/or calculating at least one corrective coefficient ($parR_{srx}$) suitable to be applied to values of the electrical resistance ($R_{srx}$) of the energy source of the receive processing unit.

4. The method according to claim 1, wherein the transfer function is determined by the following equation:

$$I_{rx} = \text{constant} + \frac{parRb1 \cdot R_b}{parRb2 + R_b} + parRr \cdot R_r + \frac{parRs_{tx}}{Rs_{tx}} \frac{parRs_{rx}}{Rs_{rx}}$$

wherein ($I_{rx}$) is the receive current detected by the receive processing unit resulting from a predefined value of the transmit voltage applied by the transmit processing unit, ($R_b$) is the ballast electrical resistance of the track section and ($parR_{b1}$) and (par $R_{b2}$) are a first coefficient and a second coefficient, respectively, suitable to be applied to values of the ballast electrical resistance, ($R_r$) is a rail electrical resistance of the track section and ($parR_r$) is a corrective coefficient suitable to be applied to values of the rail electrical resistance ($R_r$), ($R_{stx}$) is an electrical resistance of an energy source of the transmit processing unit and ($parR_{stx}$) is a corrective coefficient suitable to be applied to values of the electrical resistance of the energy source of the transmit processing unit, ($R_{srx}$) is the electrical resistance of an energy source of the receive processing unit and ($parR_{srx}$) is a corrective coefficient suitable to be applied to values of the electrical resistance of the energy source of the receive processing unit.

5. The method according to claim 1, wherein calibrating the rail track circuit comprises:

calculating actual values for one or more of a resistance selected from the group consisting of the ballast electrical resistance ($R_b$) of the rail track circuit, the rail electrical resistance of the track section ($R_r$), and the electrical resistances ($R_{stx}$, $R_{srx}$) of the energy source of the transmit processing unit and of the receive processing unit, respectively, and calibrating the rail track circuit by using the determined transfer function based on the actual values calculated for the one or more of the resistances selected from the group consisting of ballast electrical resistance ($R_b$) of the track circuit, the rail electrical resistance of the track section ($R_r$), and the electrical resistances ($R_{stx}$, $R_{srx}$) of the energy source of the transmit processing unit and of the receive processing unit, respectively.

6. The method according to claim 1, wherein calibrating the rail track section comprises adjusting, based on the determined transfer function, a first predefined threshold of the rail track circuit, and wherein the presence or absence of a railway vehicle on the track section is determined based on the first predefined threshold.

7. The method according to claim 6, wherein during calibrating the rail track section, the first predefined threshold is adjusted based on a value of the receive current determined via said determined transfer function.

8. The method according to claim 7, wherein calibrating the rail track section comprises comparing said value of the receive current determined via the determined transfer function with a value of the receive current measured at the receive processing unit and if the difference between the value of the receive current determined and the value of the receive current measured is above a second predetermined threshold, then generating an alarm, otherwise adjusting the value of said first threshold and/or of a gain of the transmit processing unit based on the value of said difference between the value of the receive current determined and the value of the receive current measured.

9. The method according to claim 1, wherein calibrating the rail track section comprises adjusting a gain of the transmit processing unit based on a value of the receive current determined via said determined transfer function.

10. The method according to claim 1, further comprising simulating the presence of a railway vehicle on the track circuit by shunting the rail track circuit and checking if a signal simulating the presence of the railway vehicle is correspondingly detected at the receive processing unit.

11. A computer-readable medium comprising software code stored therein which, when executed by a processor, executes or initiates the execution of a method according to claim 1.

12. A rail track circuit comprising:

a plurality of rails coupled to form a track section having a predefined length;

a transmit processing unit coupled to the track section at a first end of the track section, the transmit unit being configured to apply one or more predefined transmit voltages at said first end of said track section;

a receive processing unit coupled to the track section at a second end of the track section, the receive processing unit being configured to detect at said second end of the rail track circuit a receive current and to be calibrated based on a determined transfer function between a predetermined transmit voltage applied by the transmit processing unit and a resulting receive current detected at the receive processing unit, wherein the transfer function is determined by selecting or calculating one or more variables suitable to influence the values of the resulting receive current detected by the receive processing unit, the selected or calculated variables including one or more of a rail electrical resistance of the track section, a ballast electrical resistance of the track section, an electrical resistance of an energy source of the transmit processing unit, and an electrical resistance of an energy source of the receive processing unit.

13. A control system for a railway line comprising:

at least one rail track circuit comprising:

a plurality of rails coupled to form a track section having a predefined length;

a transmit processing unit coupled to the track section at a first end of the track section, the transmit unit being configured to apply one or more predefined transmit voltages at the first end of said track section;

a receive processing unit coupled to the track section at a second end of the track section, said receive processing unit being configured to detect a receive current at said second end;

a controller in communication with the at least one track circuit, the controller being configured for remotely causing calibration of the at least one rail track circuit based on a determined transfer function between a predetermined transmit voltage applied by the transmit processing unit at said first end of the track section and a resulting receive current detected at said second end of the track section by the receive processing unit, wherein the transfer function is determined by selecting or calculating one or more variables suitable to influence the values of the resulting receive current detected by the receive processing unit, the selected or calculated variables including one or more of a rail electrical resistance of the track section, a ballast electrical resistance of the track section, an electrical resistance of an energy source of the transmit processing unit, and an electrical resistance of an energy source of the receive processing unit.

* * * * *